US007757909B2

(12) United States Patent
Jones

(10) Patent No.: US 7,757,909 B2
(45) Date of Patent: Jul. 20, 2010

(54) GARMENT HANGER

(75) Inventor: Michael Edward Jones, Penymynydd (GB)

(73) Assignee: Mainetti (UK) Ltd. (GB)

( * ) Notice: Subject to any disclaimer, the term of this patent is extended or adjusted under 35 U.S.C. 154(b) by 0 days.

(21) Appl. No.: 11/871,390

(22) Filed: Oct. 12, 2007

(65) Prior Publication Data

US 2008/0264984 A1 Oct. 30, 2008

(30) Foreign Application Priority Data

Oct. 13, 2006 (GB) ..... 0620313.7

(51) Int. Cl.
*A41D 27/22* (2006.01)

(52) U.S. Cl. ..... 223/96; 223/85; 223/95

(58) Field of Classification Search ..... 223/85, 223/88, 91, 93, 95, 96; D6/328
See application file for complete search history.

(56) References Cited

U.S. PATENT DOCUMENTS

| | | | | | |
|---|---|---|---|---|---|
| D33,665 | S | * | 12/1900 | Kramer | 223/95 |
| 839,879 | A | * | 1/1907 | O'Connell | 223/95 |
| 2,129,455 | A | * | 9/1938 | Wisehart et al. | 223/96 |
| 2,940,648 | A | * | 6/1960 | Martin | 223/95 |
| 3,207,393 | A | * | 9/1965 | Pannick | 223/96 |
| 3,460,726 | A | * | 8/1969 | Rooz | 223/95 |
| 4,160,515 | A | * | 7/1979 | Frei | 223/96 |
| 4,618,080 | A | * | 10/1986 | Shalson | 223/95 |
| 5,062,556 | A | * | 11/1991 | Willputz | 223/96 |
| 5,065,916 | A | | 11/1991 | Fildan | |
| D324,459 | S | * | 3/1992 | Gouldson et al. | D6/326 |
| 5,129,557 | A | * | 7/1992 | Kolton et al. | 223/91 |
| 5,236,109 | A | * | 8/1993 | Zuckerman | 223/96 |
| D340,138 | S | * | 10/1993 | Gouldson | D6/326 |
| 5,346,110 | A | * | 9/1994 | Petrou | 223/85 |
| 5,411,189 | A | * | 5/1995 | Gouldson | 223/85 |
| 5,516,013 | A | * | 5/1996 | Gouldson et al. | 223/91 |
| D371,246 | S | * | 7/1996 | Gouldson et al. | D6/326 |
| 5,573,151 | A | * | 11/1996 | Fildan | 223/96 |

(Continued)

FOREIGN PATENT DOCUMENTS

DE 298015070 U1 2/1999

(Continued)

OTHER PUBLICATIONS

United Kingdom Search Report dated Nov. 26, 2007, Application No. GB0620313.7.

*Primary Examiner*—Gary L Welch
*Assistant Examiner*—Nathan E Durham
(74) *Attorney, Agent, or Firm*—Jack Schwartz & Associates, PLLC.

(57) ABSTRACT

A garment hanger for lingerie. The hanger includes a hook, an elongate body suspended below the hook and engaging members at the ends of the body. Each engaging member includes a one first leg flexibly connected at one end to the body and at the other end to a second leg. As a result the two legs and the body form an S-shape that acts as a spring to maintain tension in front display portion of the garment hung on the hanger. The engaging member also ensures that any excess material of the garment not forming part of the display portion is held out of view at the back.

7 Claims, 5 Drawing Sheets

U.S. PATENT DOCUMENTS

| | | | | | |
|---|---|---|---|---|---|
| D423,797 | S | * | 5/2000 | Gouldson | D6/326 |
| D453,423 | S | * | 2/2002 | Goldman et al. | D6/326 |
| 6,467,659 | B2 | * | 10/2002 | Gouldson | 223/96 |
| 6,516,980 | B1 | * | 2/2003 | Goldman | 223/85 |
| 6,588,634 | B2 | * | 7/2003 | Gouldson et al. | 223/96 |
| 6,779,695 | B2 | * | 8/2004 | Matkovich | 223/93 |
| 2002/0113100 | A1 | | 8/2002 | Gouldson | |

FOREIGN PATENT DOCUMENTS

| | | | | |
|---|---|---|---|---|
| GB | 2208266 | A | | 3/1989 |
| GB | 2269314 | A | * | 2/1994 |
| GB | 2292070 | A | | 2/1996 |

* cited by examiner

GARMENT HANGER

FIELD OF THE INVENTION

The present invention relates to a garment hanger, and relates particularly, but not exclusively, to a hanger for displaying lingerie in a retail outlet.

BACKGROUND OF THE INVENTION

The use of hangers for displaying garments in retail outlets prior to purchase, is well known. Known garment hangers comprise a suspension member for suspending the hanger from a support, an elongate body connected to the suspension member, and at least one engaging member for releasably engaging a garment.

However, known garment hangers provide a number of disadvantages. In particular, garments are often not engaged securely enough with the engaging members and as a result are susceptible to falling from the hanger and onto the floor of the retail outlet. This causes inconvenience to the retailer and often results in damage to stock.

Preferred embodiments of the present invention seek to overcome or at least alleviate at least the above disadvantage of the prior art.

SUMMARY OF THE INVENTION

In accordance with the present invention, there is provided a garment hanger comprising:—(i) a suspension member for suspending the hanger from a support; (ii) an elongate body connected to said suspension member; and (iii) engaging members adjacent respective ends of the body and adapted to releasably retain respective portions of a garment, wherein at least one said engaging member comprises:— at least one first leg flexibly connected to said body adjacent a first end of said first leg and extending at least partially away from said body; and at least one second leg flexibly connected to said first leg adjacent a second end of said first leg and extending at least partially away from said first leg and being disposed on an opposite side of said first leg to said body, said engaging member being adapted to engage said garment so that the garment engages said second leg and extends between at least one said first leg and the body.

This provides the advantage that when a user engages a first portion of a garment with the second leg and then loops the garment around such that a second portion of the garment extends between the first leg and the body, and then pulls on the second portion of the garment in a direction towards the body, the first and second legs together perform as a spring and flex in a direction towards the body along with the second portion of the garment. This in turn reduces the size of the gap between the first leg and the body and thereby improve the grip on the garment. In having this configuration, the first and second legs are able to deflect more easily in the event that the second portion of the garment is pulled in a direction towards the body. In view of this, the garment is less likely to fall from the garment hanger and onto the floor of the retail outlet.

Furthermore, the spring formed from the two legs maintains a small amount of tension in the garment as it is stretched across the hanger between the two engaging members. By tucking the second portion of the garment between the first leg and the body this also ensures that the second portion of the garment is held out of view of the customer when the hanger and garment are viewed from the front. Therefore, the greater length of excess material, resulting from putting a larger size material, resulting from putting a larger size on a hanger which will also fits a smaller size, does not interfere with the presentation of the front of the garment. As a result, the garment is attractively and consistently presented to the customer, irrespective of the garment size.

Preferably, at least one said engaging member further comprises a third leg flexibly connected to said body adjacent said first end of said first leg and extending at least partially away from said body, said third leg being disposed on an opposite side of said second leg to said first leg.

This provides the advantage that the garment may be releasably retained in a gap formed between the second and third legs, with the result that the garment is able to be more securely retained on the hanger.

Preferably, said first leg and said third legs are flexibly connected to an upper part of said body when the hanger is suspended.

This provides the advantage that the gap between the second and third legs and the gap between the body and the first leg both have downwardly extending openings when the hanger is suspended, thereby making it easier for a user to engage a garment with the hanger.

Preferably, the first, second and third legs are disposed substantially parallel to each other when the garment is not engaged with the hanger.

This provides the advantage that the garment is able to be more securely retained on the hanger, since an improved grip on the garment is provided.

Preferably, the engaging member further comprises a fourth leg flexibly connected to said body and disposed substantially transversely to the first leg, said fourth leg being adapted to engage a garment so that the garment extends between the body and the fourth leg.

This provides the advantage that a second garment, for example, a bra, can be additionally releasably engaged with the hanger. In particular, a first portion of the strap of a bra may be retained in the gap between the fourth leg and the body.

Preferably, the engaging member further comprises a fifth leg flexibly connected to said body and disposed substantially transversely to the first leg, said fifth leg being adapted to engage a garment so that the garment extends between the body and the fifth leg.

Preferably, the fourth leg is disposed on an upper part of the hanger when the hanger is suspended, and the fifth leg is disposed on a lower part of the hanger when the hanger is suspended.

This provides the advantage that a second garment can be more securely engaged with the hanger. In particular, the strap of a bra may be retained in the gaps on both the upper and lower parts of the hanger.

Preferably, the second and third legs each comprise a plurality of co-operating projections.

This provides the advantage that the first portion of the garment may be more securely engaged between the second and third legs, even in the event that the first and second legs are deflected in a direction towards the body.

BRIEF DESCRIPTION OF THE DRAWING FIGURES

A preferred embodiment of the invention will now be described, by way of example only and not in any limitative sense, with reference to the accompanying drawings, in which:—

DETAILED DESCRIPTION OF THE INVENTION

Figure 1:
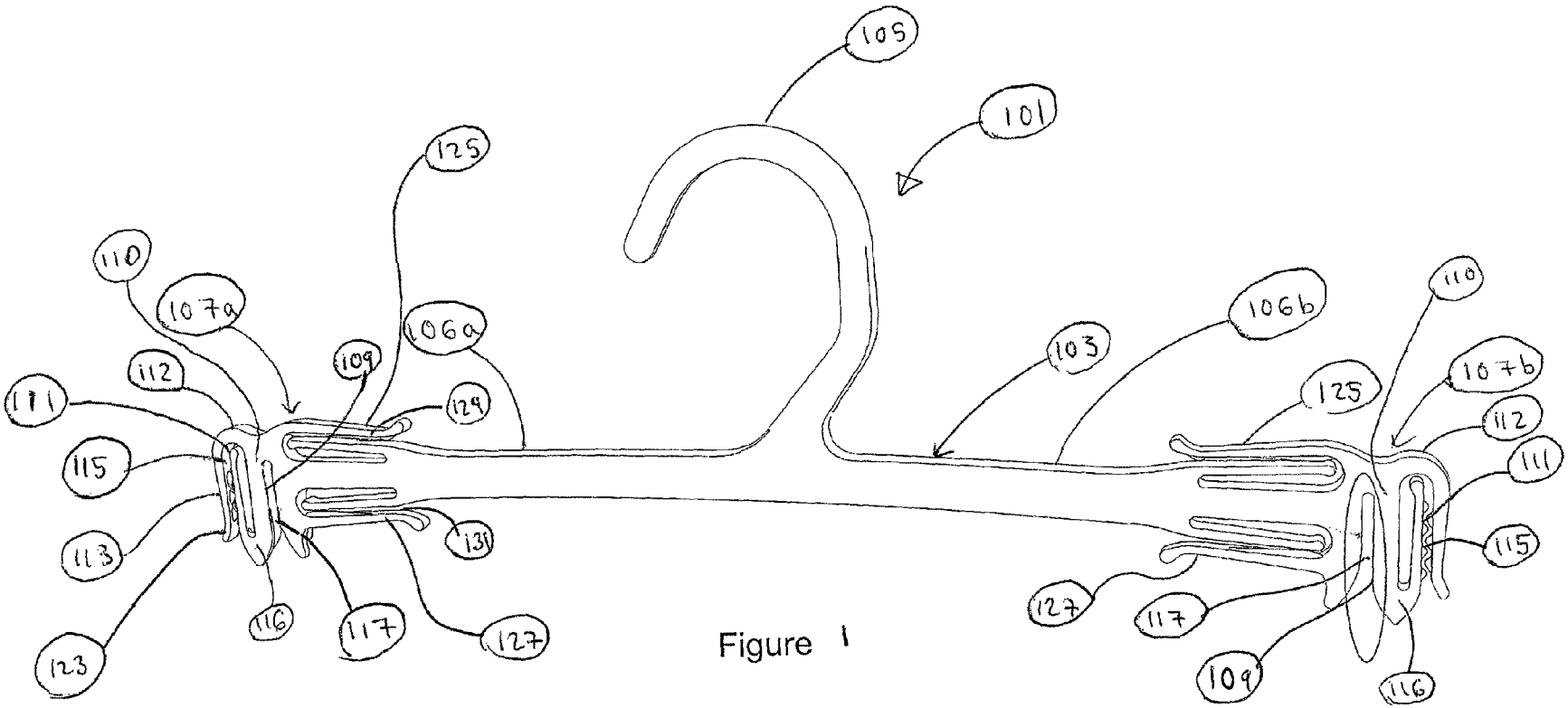
FIG. 1 shows a perspective view of a hanger embodying the present invention.
Figure 3:
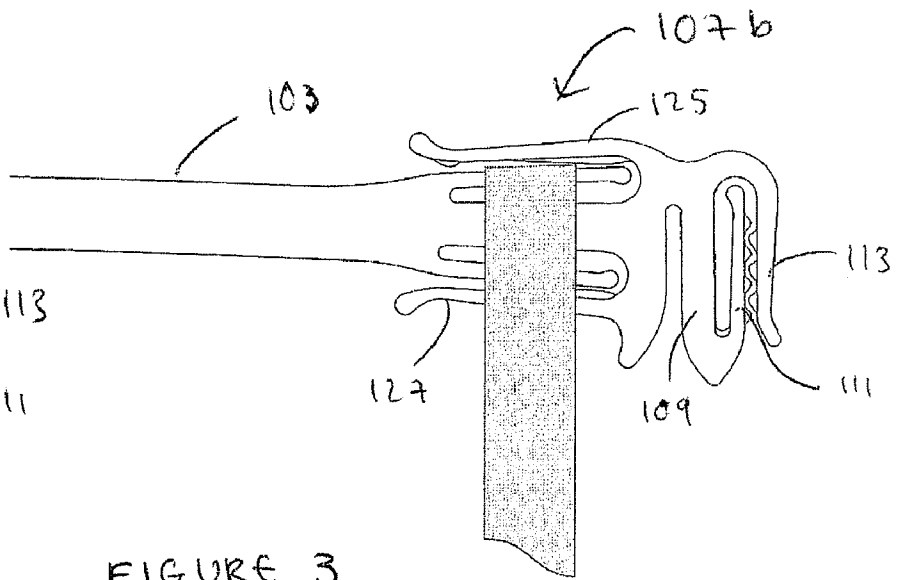
FIG. 3 shows the part of the hanger shown in FIG. 2 with a garment extending between the fourth leg and the body.
Figure 2:
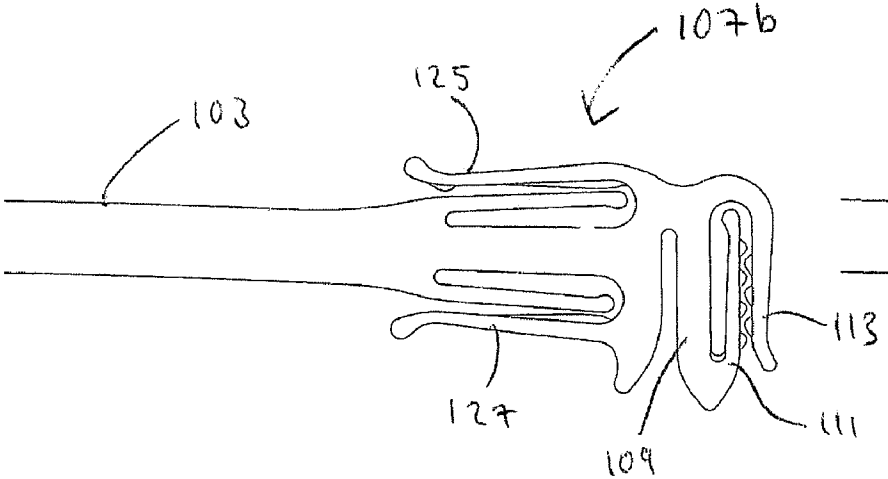
FIG. 2 shows a front view of a part of the hanger of FIG. 1.

Referring to the Figures, a hanger is represented generally by reference numeral 101. The hanger 101 comprises a body 103 and a suspension member in the form of a hook 105. The body 103 has a central portion to which the hook 105 is attached, and portions 106*a* and 106*b* extending outwardly from the central portion on opposite sides thereof. At the distal extremity of each portion 106*a* and 106*b* are disposed respective engaging members 107*a* and 107*b*.

The engaging members 107*a* and 107*b* each comprise a first leg 109 and a second leg 111. The first leg 109 is flexibly connected at a first end 110 to the body 103 by means of a linking member 112. The first end 110 of the first leg 109 is an upper end when the hanger 101 is suspended. The second leg 111 is flexibly connected to the first leg 109 adjacent a second end 116 of the first leg 109. As a result, the vertical surface of the body adjacent the first leg 109, together with the first and second legs 109 and 111 form approximately into an S-shape. The second leg 111 extends at least partially away from the first leg 109 and the body 103, and is disposed on an opposite side of the first leg 109 to the body 103.

The first 109 and second 111 legs and the body 103 are arranged such that there is a first gap 117 between the first leg 109 and the body 103. The first gap 117 has an opening which extends downwardly when the hanger 101 is suspended.

The engaging members 107*a* and 107*b* each further comprise a third leg 113 on an opposite side of the second leg 111 to the first leg 109. The third leg 113 is flexibly connected to the body 103 adjacent the first end 110 of the first leg 109 and extends at least partially away from the body 103.

Between the second leg 111 and the third leg 113 is disposed a second gap 115 having its opening extending downwardly when the hanger 101 is suspended. A free end 123 of the second leg 111 is outwardly turned in order to facilitate loading of a garment between the second 111 and third 113 legs.

Figure 5:
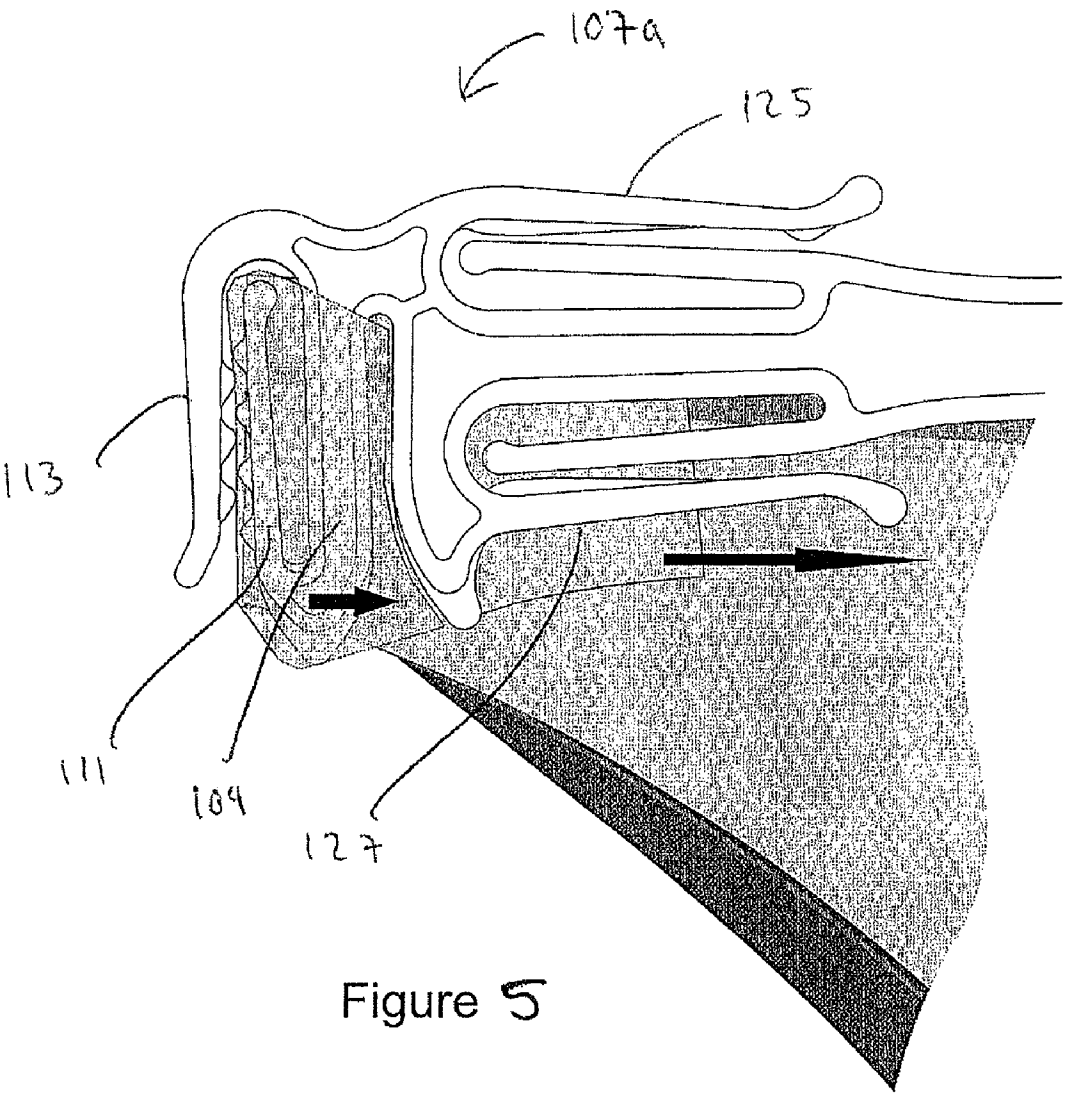
FIG. 5 shows a perspective view of the part of the hanger of FIG. 4, with the garment in a loaded condition.

The first 109 and second 111 legs are able to flex in the direction indicated by the arrows in FIG. 5, that is, in a direction towards the centre of the body 103.

The engaging members 107*a* and 107*b* each further comprise a fourth leg 125 which is flexibly connected at one end to the body 103 and which is disposed substantially transversely to the first leg 109. The engaging members 107*a* and 107*b* each additionally comprise a fifth leg 127 which is flexibly connected at one end to the body 103 and which is disposed substantially transversely to the first leg 109 and below the fourth leg 125 when the hanger is suspended. The fourth leg 125 is connected to the body 103 adjacent the first end 110 of the first leg 109, to form a third gap 129. The fifth leg 127 is connected to the body 103 to form a fourth gap 131, which is disposed below the third gap 129 when the hanger is suspended. The gaps 129 and 131 each have an opening extending in a direction towards the hook 105, that is, towards the centre of the body 103.

Figure 4:
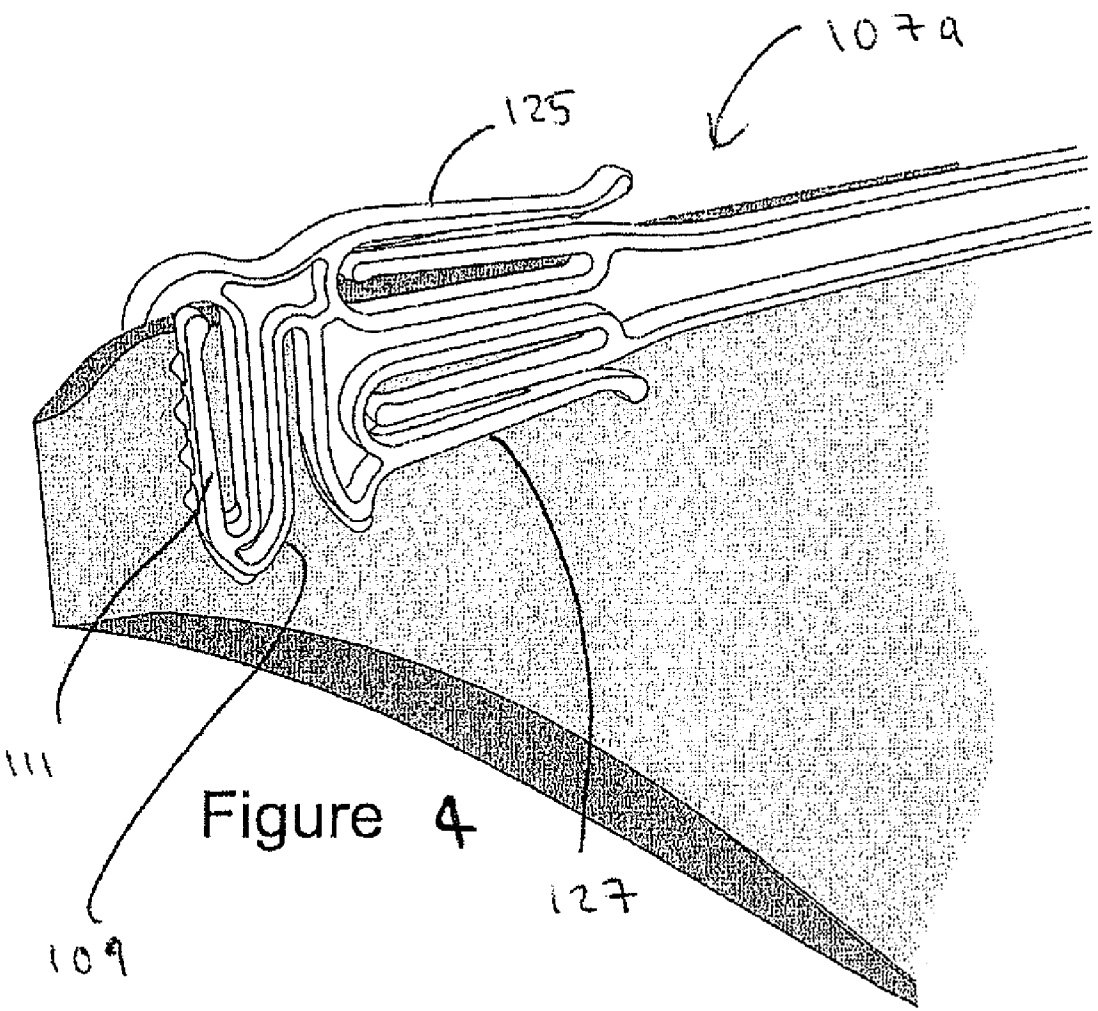
FIG. 4 shows a perspective view of a part of the hanger of FIG. 1 with a garment in a partially loaded condition.
Figure 6:
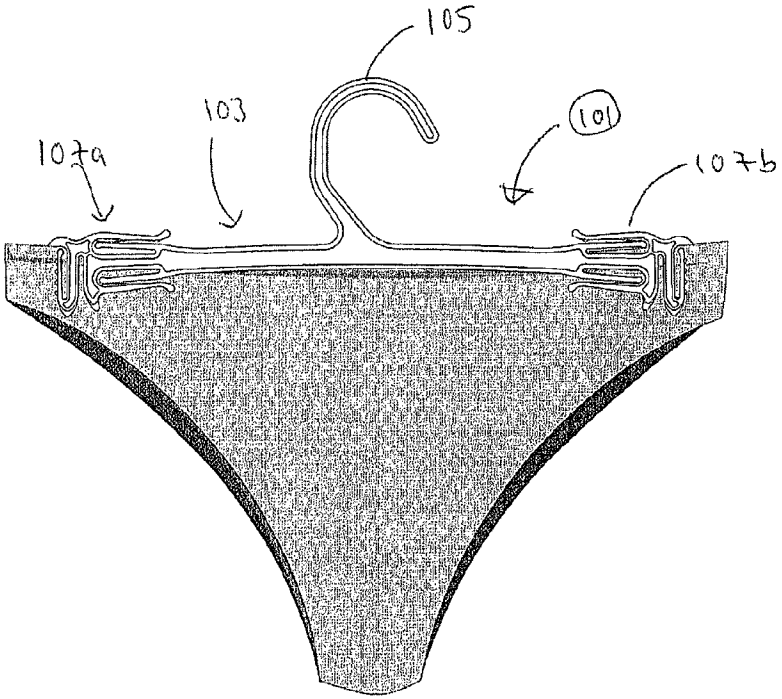
FIG. 6 shows a front view of the hanger of FIG. 1 with the garment in a partially loaded condition.

In order to use the hanger 101, a garment (which in the example shown is a pair of briefs) is laid across the hanger 101. A first portion of the briefs is inserted into the second gap 115 between the second 111 and third 113 legs of the engaging member 107*a*, as illustrated by FIGS. 4 and 6 in particular.

Figure 7:
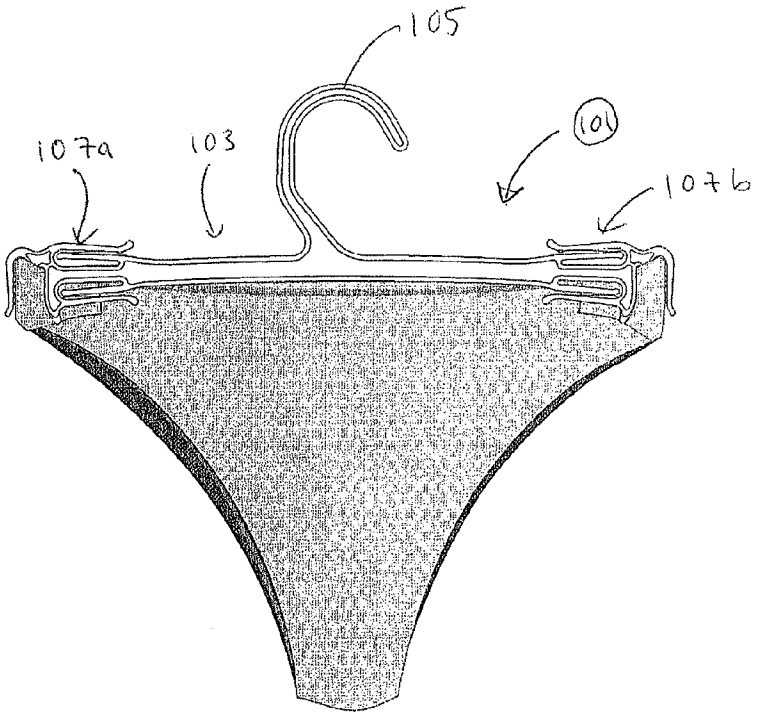
FIG. 7 shows a front view of the hanger shown in FIG. 6, with the garment in a loaded condition.

The user then loops an end portion, that is, a second portion, of the briefs around the second leg 111 such that the second portion of the briefs is inserted into the first gap 117 between the first 109 and second 111 legs, as illustrated by FIGS. 5 and 7 in particular.

The user then pulls on the second portion of the briefs, in a direction represented by the arrows in FIG. 5. In doing so, the second leg 111 flexes in a direction represented by the arrows in FIG. 5 and urges the first leg 109 to pivot about its first end 110 in a direction towards the centre of the body 103, thereby reducing the size of the first gap 117. In this way, the first 109 and second 111 legs together perform as a spring, resulting in the first and second legs flexing sufficiently to result in a tighter grip being made on the briefs. Furthermore the reduction in the first gap 117 also aids gripping of the briefs by pinching together the first leg 109 and the body 103 that have the second portion of the briefs extending between them.

The user then repeats the steps described above for the other engaging member 107*b*, with the result that the garment is securely engaged with both of the engaging members 107*a* and 107*b*, as shown in FIG. 7 in particular. When both sides of the briefs are loaded into the engaging member 107*a* and 107*b* the excess material at the sides of the brief can be pulled towards each other, that is towards the centre of the hanger. This partially stretches the briefs and pulls the first and second legs towards the centre of the hanger. When the user lets go of the briefs the spring effect of the first and second legs maintains a little tension in the front portion of the briefs which are presented to the customer. It should also be noted that by tucking the second portion of the briefs into the gap 117 this ensures that this excess material, that is material not stretched across the front of the hanger for display purposes, is held behind the hanger and out of view when presented to a customer. This also allows this hanger to be used on a greater variety of sizes of briefs since the hangers can be made so as to just fit the smallest size and for all larger sizes the excess material can be held behind the front display of the briefs on the hanger. This ability to provide a desirable forward presentation of the briefs is also accomplished without significantly increasing the volume of plastic used to form the hanger or having large functional and aesthetically undesirable features on the hanger making unsuitable for hanging just a bra.

In order to additionally display a bra on the hanger 101, a first portion of a strap of the bra is inserted into the third gap 129 between the fourth leg 125 of the engaging member 107*a* and the body 103. A body 103. A second portion of a strap of the bra is then inserted into the fourth gap 131 between the fifth leg of the engaging member 107*a* and the body. The same process with the other bra strap is repeated for the other engaging member 107*b*, with the result that the bra is engaged with both of the engaging members 107*a* and 107*b*.

In this way, the hanger 101 can securely retain one or a plurality of garments, with less likelihood of the garments becoming accidentally detached from the hanger. The illustrated hanger is readily adaptable to moulding in one piece from plastics material and is therefore inexpensive in its construction.

It will be appreciated by persons skilled in the art that the above embodiment has been described by way of example only, and not in any limitative sense, and that various alterations and modifications are possible without departure from the scope of the invention as defined by the appended claims.

The invention claimed is:

1. A garment hanger comprising:—(i) a suspension member for suspending the hanger from a support; (ii) an elongate body connected to said suspension member; and (iii) engaging members adjacent respective ends of the body and adapted to releasably retain respective portions of a garment, wherein at least one said engaging member comprises:— at least one first leg flexibly connected to said body adjacent a first end of said first leg and extending at least partially away from said body in a direction substantially perpendicular to the length of said elongate body thereby providing a gap between said first leg and said body, wherein a length of said gap is substantially parallel to said first leg; and at least one second leg flexibly connected to said first leg adjacent a second end of said first leg and extending at least partially away from said first leg and being disposed on an opposite side of said first leg to said body, said engaging member being adapted to engage said garment so that the garment engages said second leg and extends between at least one said first leg and the body, wherein said at least one said engaging member further comprises a third leg flexibly connected to said body adjacent said first end of said first leg and extending at least partially away from said body, said third leg being disposed on an opposite side of said second leg to said first leg.

2. A garment hanger as claimed in claim 1, wherein said first leg and said third legs are flexibly connected to an upper part of said body when the hanger is suspended.

3. A garment hanger as claimed in claim 1, wherein said first, second and third legs are disposed substantially parallel to each other when the garment is not engaged with the hanger.

4. A garment hanger as claimed in claim 1, wherein the second and third legs each comprise a plurality of co-operating projections.

5. A garment hanger as claimed in claim 1, wherein the engaging member further comprises a fourth leg flexibly connected to said body and disposed substantially transversely to the first leg, said fourth leg being adapted to engage a garment so that the garment extends between the body and the fourth leg.

6. A garment hanger as claimed in claim 5, wherein the engaging member further comprises a fifth leg flexibly connected to said body and disposed substantially transversely to the first leg, said fifth leg being adapted to engage a garment so that the garment extends between the body and the fifth leg.

7. A garment hanger as claimed in claim 6, wherein the fourth leg is disposed on an upper part of the body when the hanger is suspended, and the fifth leg is disposed on a lower part of the body when the hanger is suspended.

* * * * *